United States Patent [19]

Carson et al.

[11] 4,189,718

[45] Feb. 19, 1980

[54] ELECTRONIC SIREN

[75] Inventors: William H. Carson; Gerald D. Smith; Frank R. Owens, all of Indianapolis, Ind.

[73] Assignee: Carson Manufacturing Company, Inc., Indianapolis, Ind.

[21] Appl. No.: 882,606

[22] Filed: Mar. 2, 1978

[51] Int. Cl.[2] ..... G08B 3/00

[52] U.S. Cl. ..... 340/384 E; 340/384 R

[58] Field of Search ..... 340/384 E, 384 R

[56] References Cited

U.S. PATENT DOCUMENTS 3,747,092 7/1973 Smith ..... 340/384 E

*Primary Examiner*—Harold I. Pitts

*Attorney, Agent, or Firm*—Gust, Irish, Jeffers & Rickert

[57] ABSTRACT

The invention is an electronic siren comprising in combination circuitry for generating one of a square wave siren and intelligible audio signal and a power output amplifier for audibly reproducing the signal. The amplifier includes transistor circuitry having base, emitter and collector means and a first circuit for coupling the signal-generating circuitry to the base means and one of said emitter and collector means for driving the transistors of the transistor circuitry into saturation in response to the siren signal. The first circuit includes circuitry for applying a dynamic biasing voltage derived from the siren signal to one of the emitter and collector means in phase with the voltage of the siren signal applied to the base means and of a plurality and opposition to the potential drop of the junction of the base means and the other of the emitter and collector means. Speaker circuitry is coupled to the other of the emitter and collector means for audibly reproducing the amplified selected one of the aforesaid signals.

29 Claims, 6 Drawing Figures

ELECTRONIC SIREN

BACKGROUND OF THE INVENTION

1. Field of the Invention

The present invention relates to electronic siren circuits and more particularly to an improved, compact electronic siren circuit which provides relatively high output power with maximum efficiency.

2. Description of the Prior Art

Prior art electronic siren circuits, such as that disclosed in U.S. Pat. No. 3,051,944 and U.S. Pat. No. Re. 28,745, typically include a voltage controlled variable frequency oscillator which generates a square wave output signal, the square wave having a repetition rate or frequency in the audio frequency range. These circuits further include voltage signal generating circuits which apply a selected one of a plurality of different wave forms to the variable frequency oscillator to produce the desired siren signal. The output signal of the voltage controlled variable frequency oscillator is then applied to a speaker through a suitable power amplifier.

In the majority of applications, the electronic siren is installed in a motor vehicle or similar mobile unit. Consequently, the power and space available to operate and install the siren is limited. For this reason, and due to the need to produce a siren sound having a sufficient volume to be heard above normal ambient sound levels, it is important that the siren circuit produce the desired siren sounds at a relatively high level with maximum efficiency. In this regard, prior art electronic siren circuits exhibit loss of efficiency which results from power losses within the amplifier circuit.

SUMMARY OF THE INVENTION

The invention in its broader aspects is an electronic siren circuit which comprises means for generating selectively either a square wave siren signal or an intelligible audio signal, in combination with a power output amplifier for amplifying the signal. The power output amplifier includes a first transistor circuit including two Darlington transistor pairs in push-pull. The signal generating circuit is coupled to the base elements of the first transistors of said Darlington pairs. A biasing circuit is utilized to apply a dynamic biasing voltage derived from the siren signal to the collector elements of said first transistors in phase with the voltage of the siren signal. The polarity and magnitude of this biasing voltage is such to overcome the potential drop of the junction of the emitter and collector elements of said first transistors and to drive the second transistors of the Darlington pairs into saturation. Speaker devices are coupled to the emitter and collector elements of the second transistors for audibly reproducing the amplified selected one of the siren and audio signals.

The signal generating circuit includes a first circuit for generating selectively a plurality of control voltage signals having predetermined wave shapes and frequencies and a second circuit under the control of the first circuit which generates siren signals at a variable frequency proportional to the amplitude of the voltage of the aforesaid control signals. The first circuit includes function switch means for manually selecting predetermined ones of said control signals, the first circuit also including an auxiliary switch means for manually switching the first circuit successively between two of the control signals, for example, wail and yelp, when the function switch means is operated to select one of these two control signals and for manually switching the first circuit to select a third control signal, for example, an airhorn sound, when the function switch means is operated to select a fourth control signal, such as two tone or yelp.

It is an object of this invention to provide an improved electronic siren circuit having increased power efficiency.

It is another object to provide an improved electronic siren circuit of improved reliability and durability at a relatively low cost.

It is another object to provide an electronic siren circuit which may be operated to select one of a plurality of available siren and intelligible signals and which may be further operated to override the siren signals with an airhorn signal, conveniently to select alternately one of two specific siren signals, or to provide public address override of selected siren signals.

It is still another object of this invention to provide an electronic siren which may be switched manually to produce one of a number of primary siren signals and further switched manually to produce an overriding airhorn signal by means of essentially the same circuitry that produces the siren signals.

It is yet another object of this invention to provide for an electronic siren a transistorized power amplifier which when operated in the siren mode is driven into saturation with minimum power loss and in the audio mode is operated to reproduce the input signals with minimal distortion.

It is a further object of this invention to provide in such a power amplifier a dynamic biasing circuit that facilitates driving the transistors into saturation with minimum power loss when operating in the siren mode.

It is yet another object of this invention to provide in such a power amplifier circuitry which protects against transistor burn-out in the event of a short developing in the speaker circuitry.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
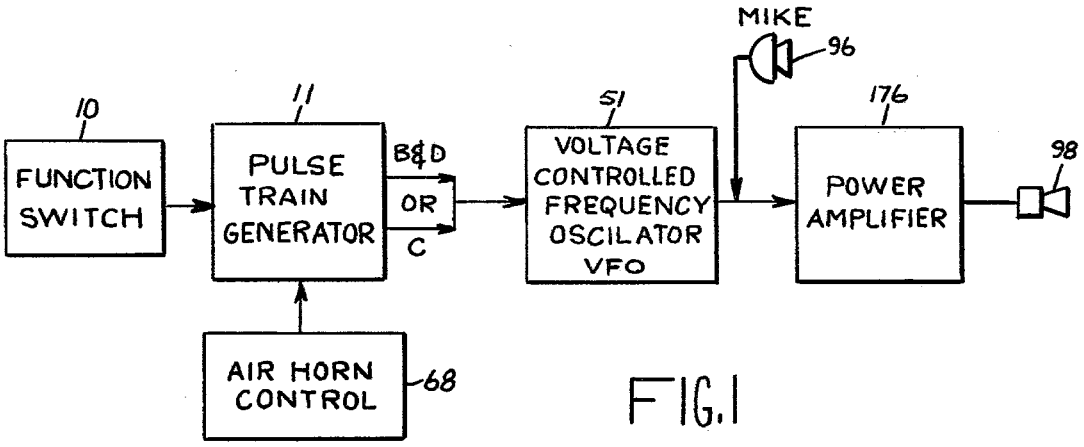
FIG. 1 is a block diagram of one embodiment of this invention.

The apparatus of this invention is capable of being operated basically in two different modes, the first being audibly to reproduce intelligence in the form of amplified voice and radio signals, and the second in a plurality of different siren tones. Selection of the mode of operation is accomplished by means of manually operable rotary function switch having wafer sections 10, 160 and 162 and having six different positions. These positions are numbered 1 through 6 on the stator contacts. Position 1 is for reproducing received radio signals, position 2 for using the apparatus as a public address system, position 3 for a manual siren sound, position 4 for a wail sound, position 5 for yelp and position 6 for two tone, otherwise sometimes referred to as "high-low".

The various siren tones are as follows. The manual tone, produced by the operator by repeatedly closing and opening a control switch, produces rising and falling tones determined by the length of time the switch is opened and closed. The wail is evidenced by a steady rise followed by a fall of tones. The yelp is characterized by repetitive rising and falling of tones corresponding to the wail frequencies but more rapidly. Two tone operation produces two discrete different frequencies alternately according to a train of square wave pulses, the tone alternating at the rate of 60 pulses per minute between high and low frequencies. An air horn sound, not selectable by means of switch 10 and selected by switching circuits later described, is a steady sound composed of the two tone frequencies and is created by the same two tone square wave pulse train repeating at a much higher rate, such as 60 pulses per second.

The integrated circuits (IC's) used in this apparatus are CMOS IC's. They have the characteristic in that the gate output changes state as the input voltage passes through a nominal threshold voltage level of one-half the supply voltage. When operated at a supply voltage of eight (8) volts, the threshold level is four (4) volts. Thus, a logic 0 signal corresponds to a voltage below four (4) volts and a logic 1 above four (4) volts.

Figure 2:
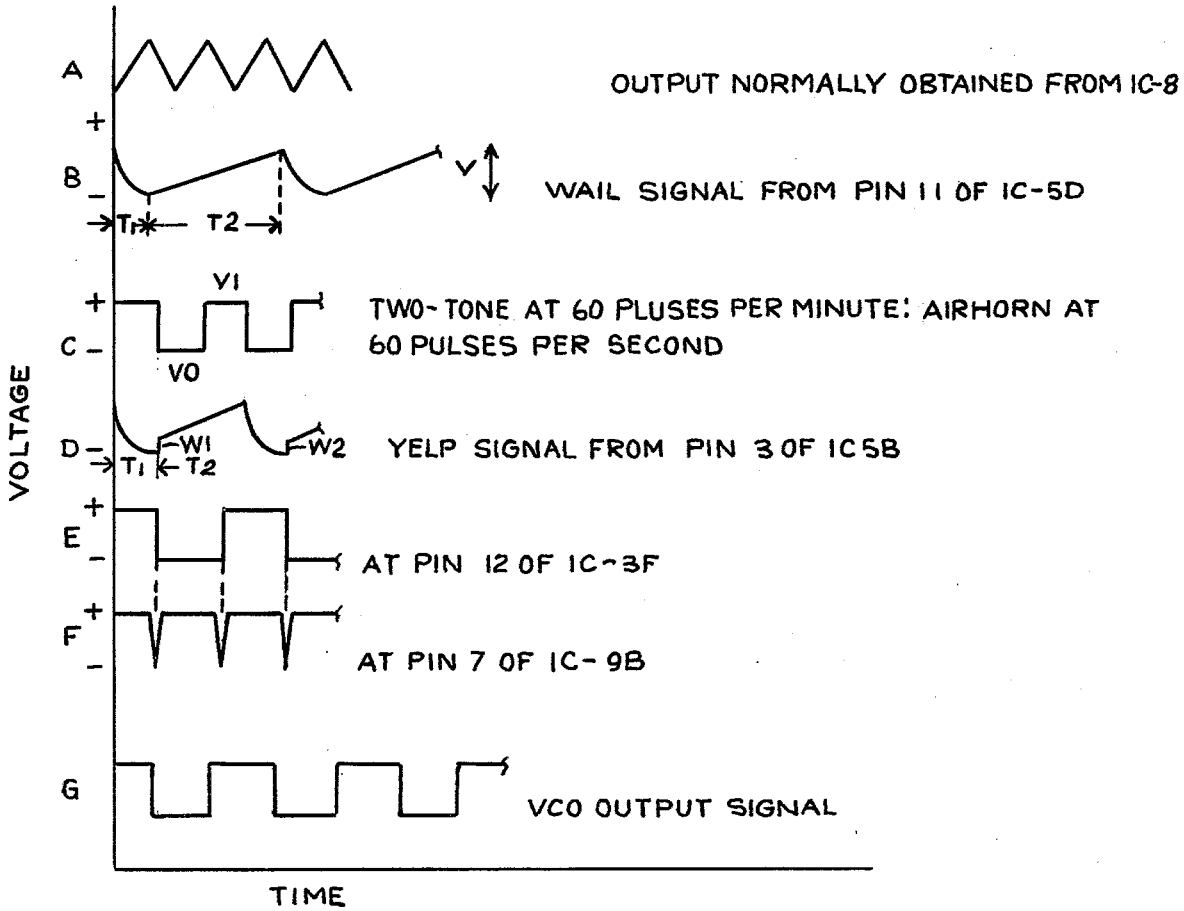
FIG. 2 is a diagram showing wave forms occuring in the electronic siren of this invention and useful in explaining the operation thereof.
Figure 3A:
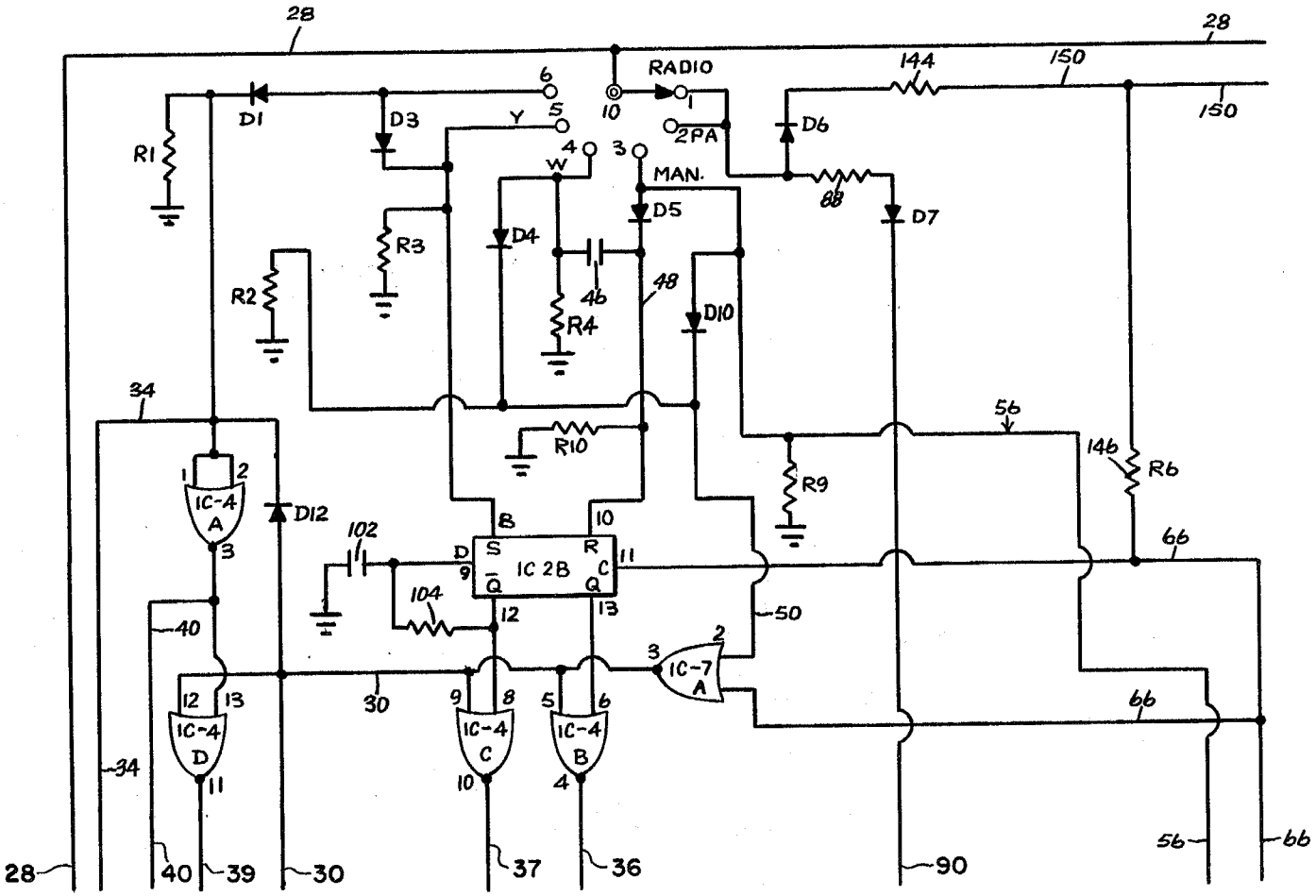
FIGS. 3A, 3B, 3C and 3D together are a circuit diagram of a working embodiment of this invention.
Figure 3B:
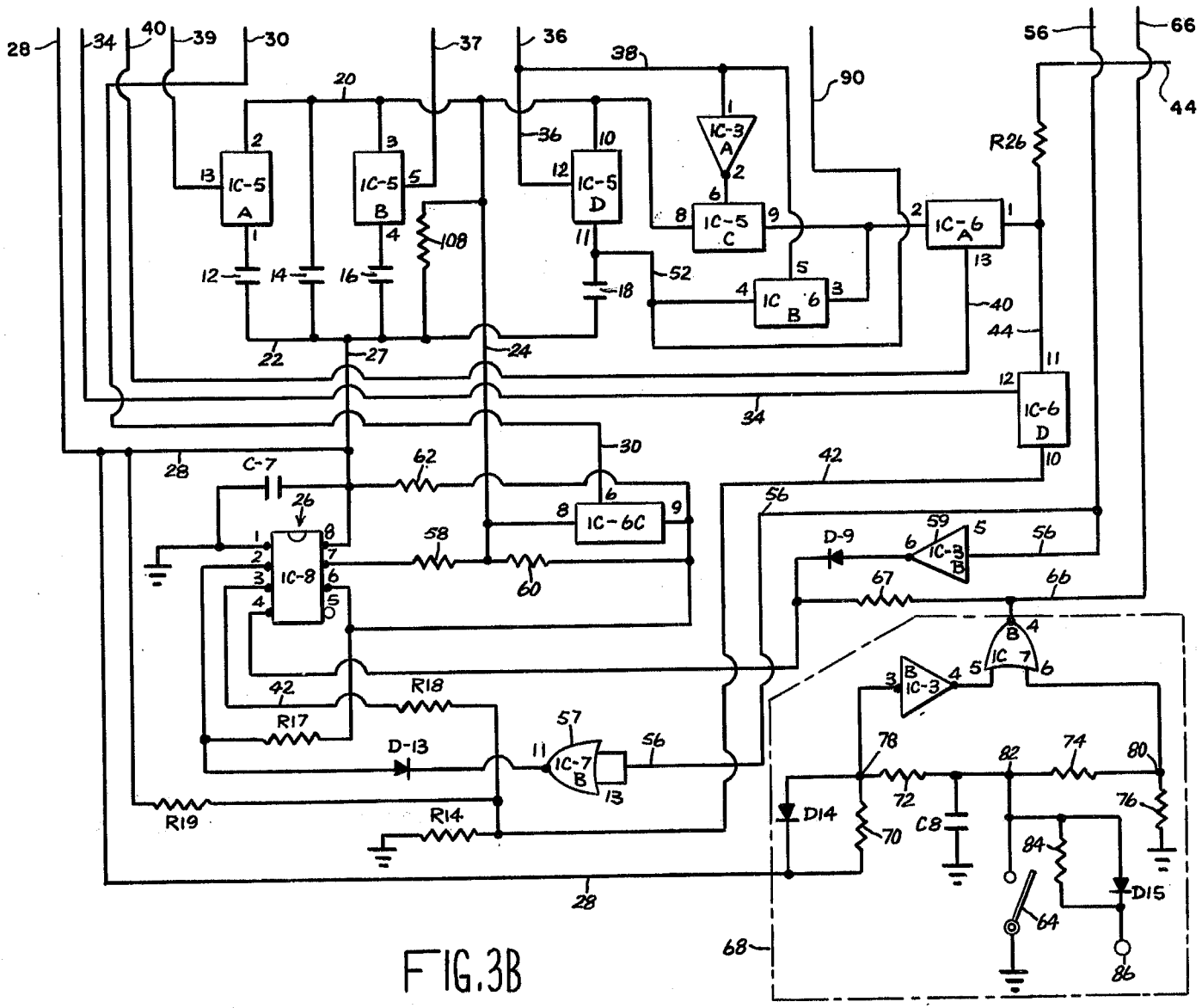
Figure 3C:
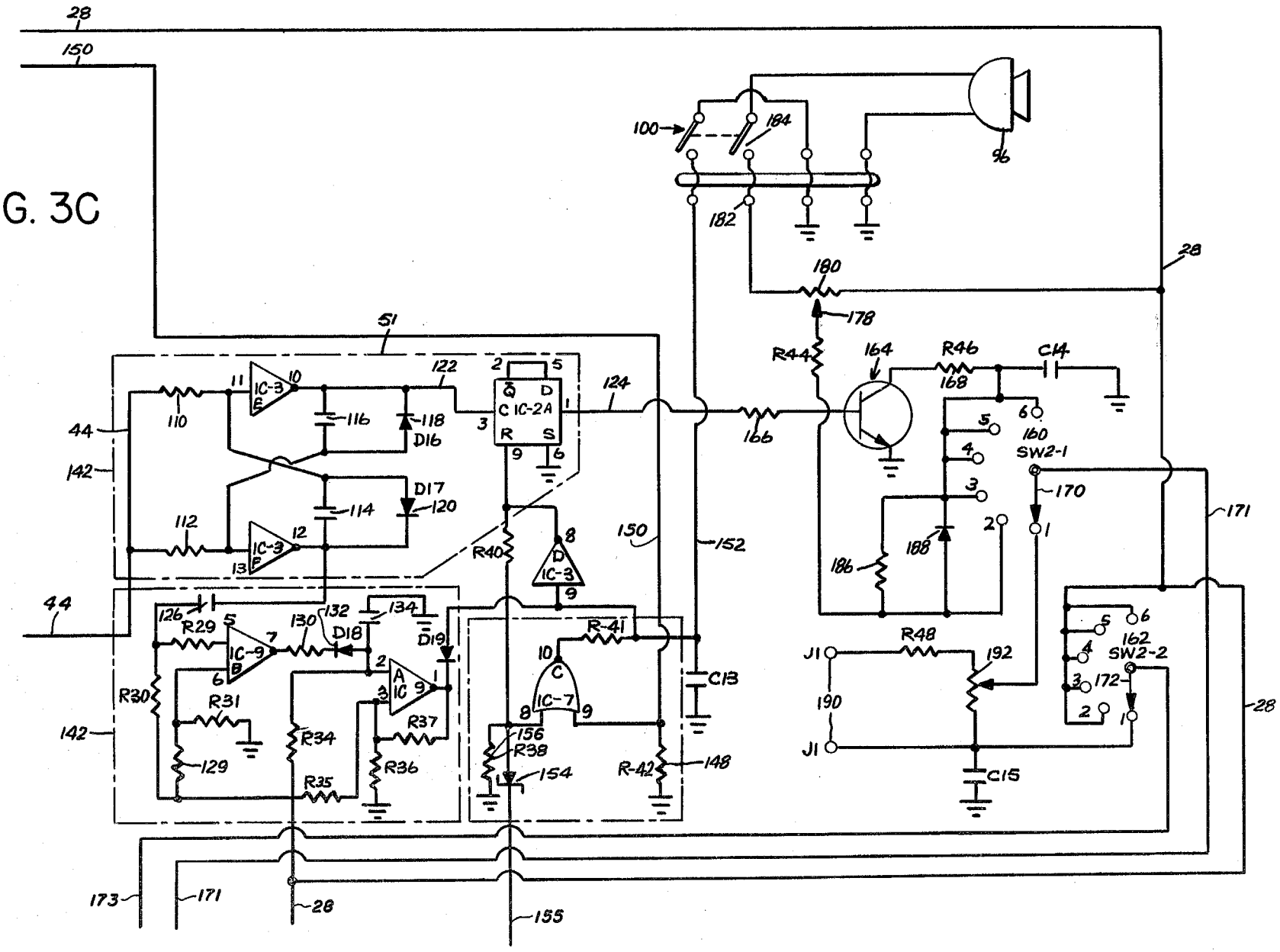
Figure 3D:
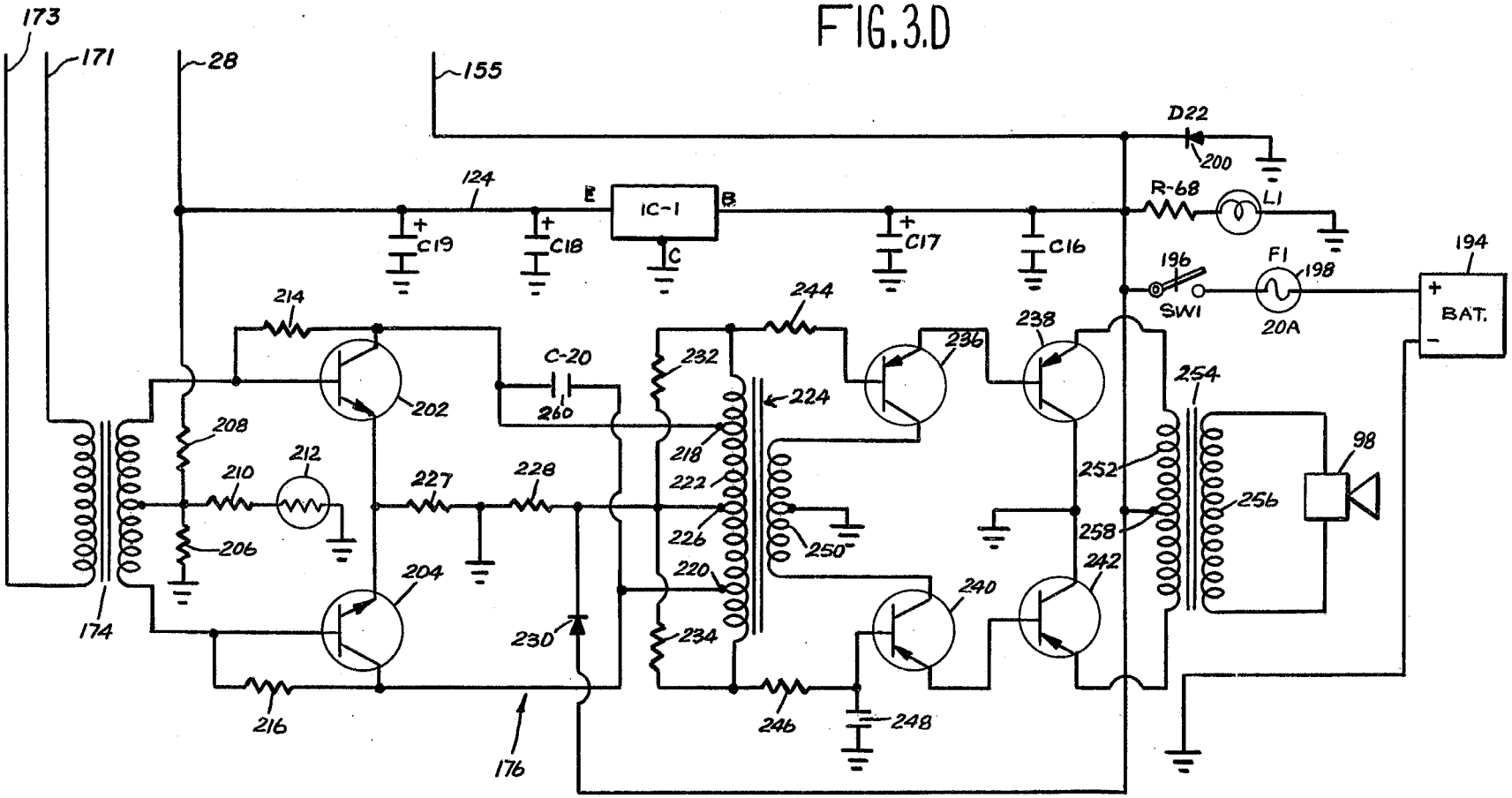
Figure 3C:
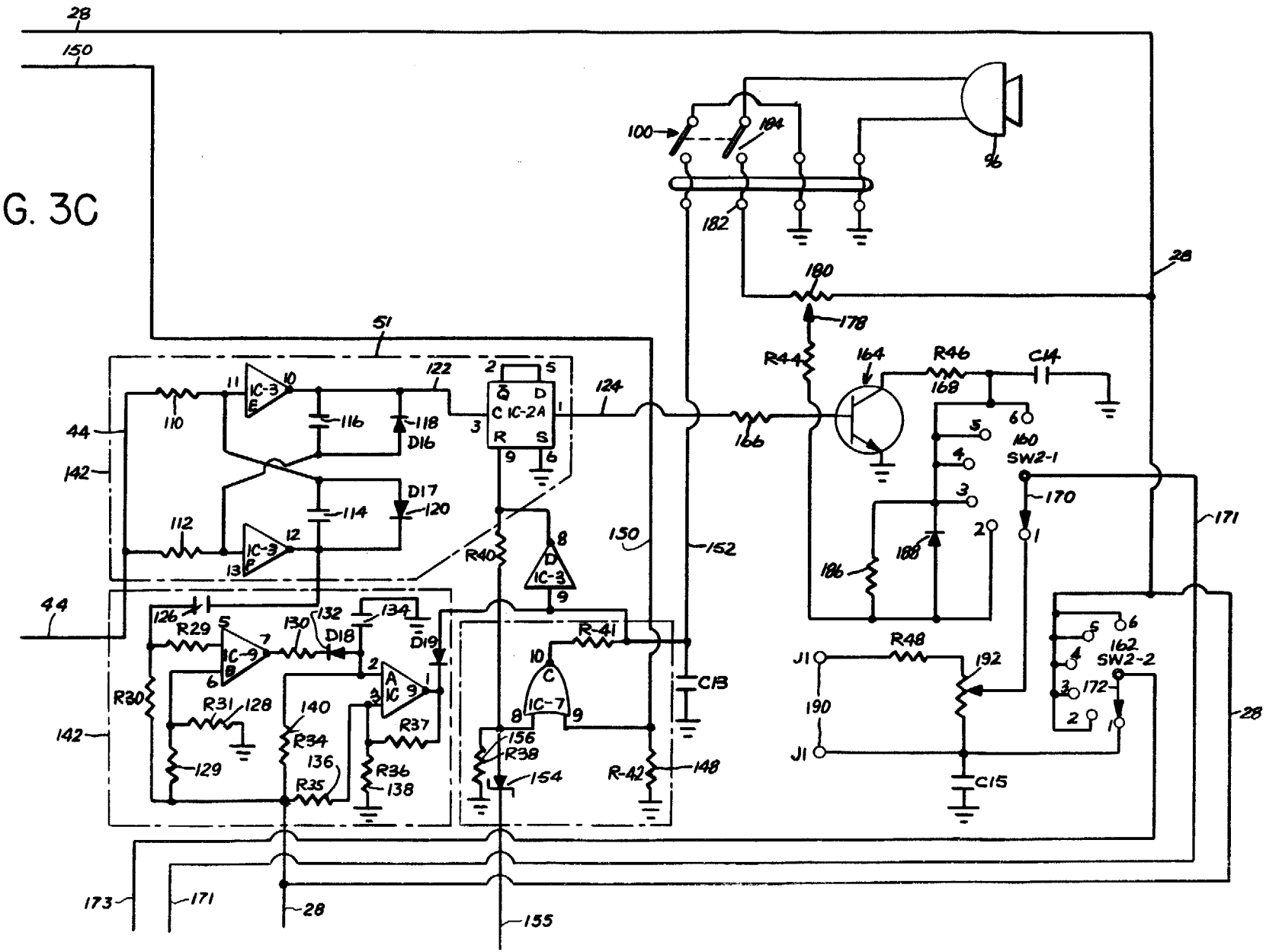

Before considering total circuit operation in connection with generating the various siren sounds depending upon the position of switch section 10, the circuitry for generating the various siren sounds will be described first. Generally speaking, the capacitors 12, 14, 16 and 18 are of different values and are connected into a time constant and ramp-generating circuit for producing repetitive wave forms of different repetition rates and shapes. These capacitors are coupled between two lines 20 and 22 by means of relay gates IC-5A, IC-5B and IC-5D, respectively, capacitor 14 being connected directly between these two lines 20 and 22. The symbol "IC" is used herein to denote "integrated circuit". When IC-5A is turned "on" by means of a logic 1 applied to pin 13, capacitor 12 is directly connected between lines 20 and 22. The same action occurs for the other relay gates IC-5B and IC-5D for the respective capacitors 16 and 18. Two lines 24 and 27 lead from lines 20 and 22 to the ramp generator circuit indicated generally by the numeral 26, the ramp generator including IC-8. The circuit of ramp generator 26 in combination with the capacitors 12 through 18 provide the repetition rates and shapes of the siren control signals as depicted in FIG. 2, signals B and D normally appearing on line 20 and signal C at the pulse output pin 3 of IC-8. The time constant of the particular signal selected as between contacts 4, 5 and 6 of switch 10 will be determined by the respective capacitances of the capacitors 18, 16 and 12 in parallel with 14, respectively.

More specifically, with respect to signals B and D (FIG. 2), the first portion designated by time "T1" has a curved front as shown with the second portion "T2" of longer duration gradually increasing to the maximum voltage level. Signal D has substantially the same shape except for much shorter rise and fall times.

The gate IC-5D possesses about 300 ohms impedance when conducting. In conjunction with the charging and discharging of capacitor 18, this impedance produces the jumps seen in wave form D of FIG. 2 labeled as W1 and W2. These jumps in the wave form appear at pin 10 of IC-5D. For the yelp signal which is at a much higher rate than the wail signal, these jumps W1 and W2 have no appreciable effect on the operation of the variable frequency voltage controlled oscillator (VCO) to be described later. However, for the wail signal these jumps W1 and W2 could cause unwanted frequency deviations in the control of the voltage controlled oscillator 51, so the charge-discharge characteristic of capacitor 18 is tapped off the capacitor 18 directly via line 52. The wave there appearing corresponds to the shape of wave B without the components W1 and W2.

TWO TONE CIRCUITRY

Returning now to the circuitry associated with contact 6 of switch 10, diode D1 is connected between this contact 6 and pins 1 and 2 of NOR gate IC-4A. Pin 3 of this NOR gate connects as shown to NOR gate IC-4D, the output pin 11 being connected to the gate pin 13 of IC-5A.

Another diode D3 connects from contact 6 to set pin 8 of the dual D-flip-flop IC-2B. The $\overline{Q}$ pin 12 connects to an IC-4C NOR gate as is Q pin 13 to NOR gate IC-4B. With respect to the flip-flop circuit IC-2B, pin 8 is "set", pin 10 "reset", pin 11 "clock", pin 13 "Q", pin 12 $\overline{Q}$ and pin 9 is "D". In general, in the operation of this flip-flop circuit, when the set pin goes to logic 1, Q output goes to logic 1; and when the reset pin 10 goes to logic 1, Q output goes to logic 0, both of these control functions being independent of the clock input. When the D input 9 goes from 0 to 1, the Q output will go from 0 to 1, respectively, but only on the next clock signal. The $\overline{Q}$ output goes opposite to the Q output.

Explaining the operation of the circuitry thus far described and with the switch 10 turned to contact 6, supply voltage on line 28 as logic 1 is applied to the input terminals of NOR gate IC-4A. A low or logic 0 is produced at pin 3 which is coupled to pin 13 of NOR gate IC-4D. Assuming at this point that logic 0 is present on line 30, an output 1 appears at pin 11. This output 1 or high applied to pin 13 of IC-5A couples pins 1 and 2 together thereby connecting 39 mfd capacitor 12 between lines 20 and 22. Simultaneously, supply voltage from contact 6 is connected by means of diode D3 to set line 32 connected to pin 8 of IC-2B. This results in output 0 being produced at pin 12 coupled to NOR gate IC-4C. Since output 0 appears on line 30, output 1 appears at pin 10 which turns "on" gate IC-5B connecting pins 3 and 4 together. 15 mfd capacitor 16 is thus also connected between lines 20 and 22 thereby placing capacitors 12 and 16 in parallel.

The same control signal applied to input pins 1 and 2 of IC-4A is connected by line 34 to the gate pin 12 of relay gate IC-6D which connects pins 10 and 11 together.

Now referring again to flip-flop circuit IC-2B, with pin 12 being at output 0, pin 13 must be at output 1. This results in output 0 at pin 4 of NOR gate IC-4B which is connected by line 36 to the input gate 12 of IC-5D and the line 38 to the inverter IC-3A connected to the input gate 6 of IC-5C. Also line 38 is connected to input gate 5 of IC-6B. With output 0 on line 38, relay gate IC-6B is turned "off" thereby preventing any signal from being coupled from 200 mfd capacitor 18. However, output 1 appears at pin 2 of inverter IC-3A which turns "on" relay gate IC-5C. This couples line 20 to pin 2 of relay gate IC-6A. IC-6A, however, is turned "off" by reason of pin 13 connection via line 40 to the output pin 3 of NOR gate IC-4A. Since under the previously assumed conditions output 0 appears at this pin 3, relay gate IC-6A is turned "off".

Capacitors 12 and 16 are thereby placed in circuit with the ramp generator 26 via lines 24 and 27. A train of square wave pulses at a repetition rate of 60 pulses per minute, denoted by the letter C in FIG. 2, is produced at pin 3 of IC-8 which is connected by means of line 42 to pin 10 of relay gate IC-6D. Since this relay gate IC-6D has been turned "on" by the high signal applied to pin 12, signal C is connected through to pin 11 of IC-6D to which is connected the siren signal line 44 which carries all siren signals to the voltage controlled oscillator 51 to be explained in detail later. Suffice it to say for the moment, with the appearance of signal C on siren signal generator output line 44, the operation of that portion of the circuitry characterized as that which produces the two tones or "high-low" siren signal is completed.

A resistor 108 connected between lines 20 and 22 serves in shaping the waves for all siren signal modes.

With respect to the square wave signal C, it has maximum and minimum voltage levels indicated by the symbols V1 and V0, these different voltages when applied to the voltage controlled oscillator 51 serving to produce high and low audio frequency outputs which are amplified later and applied to a speaker 98.

YELP CIRCUITRY

The yelp circuit actuated by operating switch 10 to contact 5 will now be described. In this condition of operation, NOR gates IC-4D and IC-4B have logic 1 applied to the inputs thereof thereby producing logic 0's at the outputs which trigger relay gates IC-5A and IC-5D "off". With a high input connected to pin 8 of IC-2B, $\overline{Q}$ goes to logic 0. Since line 30 is at logic 0, this results in logic 1 appearing at pin 10 of IC-4C turning "on" relay gate IC-5B. This places 15 mfd capacitor 16 in circuit between lines 20 and 22. Since logic 0 is now applied to the input pins of NOR gate IC-4A, an output 1 appears on line 40 which connects to gate pin 13 of relay gate IC-6A. This effectively connects pins 1 and 2 together and to the siren signal generator output line 44. Since logic 1 appears at pin 13 on flip-flop IC-2B, gate IC-4B has an output 0 on line 38 which is inverted by IC-3A to apply a logic 1 output to pin 6 of relay gate IC-5C. This effectively connects pins 8 and 9 together thereby establishing a conductive path between line 20 and generator output line 44. By reason of the interaction between capacitor 16 and ramp generator 26, signal D (FIG. 2) appearing on line 20 is now conducted to the generator line 44, relay gate IC-6D being in an "off" state by reason of the logic 0 on line 34.

WAIL CIRCUITRY

The wail circuitry will now be described which functions upon operating switch 10 to contact 4.

The wail signal B (FIG. 2) is of a configuration in which the voltage decrease time T1 is smaller than the voltage increase time T2. The voltage controlled oscillator 51 which varies in frequency with applied voltage has a negative frequency coefficient meaning that as the voltage decreases to the VCO the output audio frequency increases. This provides the desired wail tone.

This circuit includes a capacitor 46 connected between pin 4 and line 48 leading to pin 10 of the flip-flop IC-2B. Also, diode D4 connects between contact 4 and line 50 coupled to the input of NOR gate IC-7A to apply a logic 1 to pin 2 resulting in a logic 0 on pin 3. In operation, with high voltage applied to contact 4, a short pulse of voltage is coupled to line 48 by means of capacitor 46. This pulse when applied to pin 10 of flip-flop circuit IC-2B triggers pin 13 low. With a low on line 30, NOR gate IC-4B provides logic 1 at its output pin 4 connected by means of line 36 to gate pin 12 of relay gate IC-5D. This gate connects the capacitor 18 to line 20 and thus in circuit with the ramp generator circuit 26. When relay gate IC-5D is thus rendered conductive, the other two gates IC-5A and IC-5B are gated to a non-conductive state by reason of the logic 1 on pin 12 of flip-flop circuit IC-2B and logic 1 provided at pin 13 of NOR gate IC-4D. Capacitor 18 having a relatively high capacitance causes the development of wail signal wave B which is of longer duration than the yelp signal wave D (FIG. 2). Wail signal B is taken off pin 11 of relay gate IC-5D and applied to pin 4 of relay gate IC-6B via line 52. Since logic 1 now appears on pin 5 of gate IC-6B by reason of logic 1 on pin 4 of gate IC-4B, the signal appearing at pin 11 of IC-5D is connected to pin 2 of relay gate IC-6A, via gate IC-6B. This gate IC-6A is in a conductive state by reason of the logic 1 on line 40 thereby conducting this wail signal B to generator output line 44.

A further function should be noted with switch 10 in the position of contact 4. Diode D4 conducts the high voltage from contact 4 via line 50 to NOR gate IC-7A, thus assuring that line 30 is at logic 0.

When switching from public address position 2 to wail position 4, or manual position 3, it is desirable that the sound begin at the initiation of signal B. This is accomplished by discharging the capacitor 18 through resistor 88 and diode D7 while the function switch is on PA position 2 such that when it is switched to position 3 or 4, the wail signal will start at its beginning.

MANUAL SIREN

For manual siren operation, switch 10 is operated to contact 3. This high signal on contact 3 is connected by means of diode D10 via line 50 to pin 2 of NOR gate IC-7A. This maintains the line 30 at logic 0. Returning to contact 3, diode D5 is connected via line 48 to reset pin 10 of the flip-flop circuit IC-2B. This results in logic 0 on pin 13 and the activation of NOR gate IC-4B to produce a 1 signal on the output lines 36 and 38. Relay gate IC-5D is rendered conductive thereby placing capacitor 18 in circuit between lines 20 and 22 as previously described. Also, logic 1 on line 38 through the inverter IC-3A renders gate IC-5C non-conductive but conversely renders gate IC-6B conductive thereby establishing a conductive path between capacitor 18 and the input pin 2 of gate IC-6A. Since pin 13 of gate IC-6A still has a logic 1 coupled thereto, a conductive circuit is established to generator output line 44 from capacitor C6.

For the "manual" siren mode, the ramp generator 26 must be disabled. This is accomplished by the high signal on contact 3 and line 56, inverted by NOR gate 57, which effectively grounds pin 2 of IC-8 through diode D13, disabling generator IC-8. The high signal on line 56 is also inverted by inverter 59 which removes the logic 1 clamp through diode D9 to reset pin 4 of IC-8. This pin 4, when set to logic 0, effectively grounds pin 7 of IC-8 which is connected to the left end of resistor 58. This resistor 58 is series connected with two other resistors 60 and 62 and the supply line 28. The object at this point is to control the charging and discharging of 200 mfd capacitor 18 manually, the voltage appearing over the capacitor 18 being connected to generator output line 44 via the two gates IC-6B and IC-6A.

As will be explained in detail hereinafter, a manually operated switch, such as switch 64, when closed results in producing logic 0 or ground potential on line 66. Since the clamping diode D9 is now reverse biased and essentially open, the logic 0 on line 66 is connected through resistor 67 to pin 4 of IC-8 thereby resulting in grounding the left end of resistor 58. Whatever charge there may be on capacitor 18 is now passed to ground via pin 7 of IC-8 and resistor 58. Opening of the switch 64 results in the line 66 rising to a 1 and effectively removes the ground from the left end of resistor 58. Capacitor 18 now charges from line 28, through resistor 62, resistor 60 and line 24. This charging characteristic is picked off capacitor 18 adjacent pin 11 of gate IC-5D and conducted to output line 44 via the gates IC-6B and IC-6A. Thus, rising and falling siren tones can be produced by closing and opening switch 64 manually which controls the charging and discharging of capacitor 18.

AUXILIARY OVERRIDE CIRCUIT

The auxiliary override circuit is shown in FIG. 3 as being included in the dashed line box 68. Before explaining this circuit in detail, it will be remembered that the various functions previously described depended upon the character of the logic 0 or 1, on line 30. The character of this logic signal can be controlled by the auxiliary override circuit 68. This circuit comprises a voltage divider network consisting of four resistors 70, 72, 74 and 76 connected between supply line 28 and ground. Between the junctions 78 and 80 in this divider network is series connected an inverter gate IC-3B and the input pins of NOR gate IC-7B. Another junction 82 is connected to ground by means of a switch 64 normally spring biased open to be manually operated by the operator. Also to this junction 82 is connected in shunt diode D15 and resistor 84, a terminal 86 being provided for connection to another switch which may apply thereto either a high supply voltage or ground. More specifically, terminal 86 may be connected to the horn ring switch on the vehicle steering wheel which for some vehicles is connected into the vehicle supply voltage circuit or to ground depending upon how the vehicle electrical system may be connected. Suffice it to say, either ground or high voltage applied to terminal 86 will result in the same output function of the circuit 68.

The integrated circuits (IC's) used in this circuit are CMOS IC's . They have the characteristic in that the gate output changes state as the input voltage passes through a nominal threshold voltage level of half the supply voltage. Since in the apparatus of this invention the supply voltage is maintained at 8 volts, then the threshold voltage is 4 volts for gates IC-7B and IC-3B. With the switch 64 and another switch connected to terminal 86 "open", the voltage divider network provides 5.3 volts at junction 78 and 2.7 volts at junction 80. The 5.3 volts at junction 78 is inverted by IC-3B to provide an output 0 at pin 4 connected to pin 5 of IC-7B. Simultaneously, a low condition on pin 6 of IC-7B of 2.7 volts, being lower than the 4 volt threshold point necessary to change the state of IC-7B may be considered as a logic 0 signal. Under these conditions, the logic 1 appears in the output circuit of circuit 68 at pin 4 of IC-7B. With the input pins 5 or 6 of IC-7B at logic 0, then the output signal at 4 will be 1 which is the usual signal appearing on line 66 unless switch 64 or the switch connected to terminal 86 is closed.

In order to change the signal on line 66 to 0, switch 64, for example, is closed. This drops the voltage on junction 78 to 2.7 volts which is below the trigger point thereby applying a 0 signal to pin 3 of gate IC-3B. A 1 signal is then provided at pin 4 of IC-3B which changes the state of IC-7B such that a 0 signal is applied to line 66. The same thing occurs if terminal 86 is connected to ground. However, if terminal 86 is brought to a supply voltage of, for example, something above 11 volts, a voltage appears at junction 80 which is above the threshold point of 4 volts thereby causing gate IC-7B to change state to provide logic 0 on line 66.

As will be noted, line 66 leads to clock pin 11 of the flip-flop circuit IC-2B and also to pin 1 of NOR gate IC-7A. Insofar as the preceding discussion is concerned with respect to the various siren functions, and assuming that the auxiliary circuit 68 has not been activated, logic 1 will normally appear on line 66 and pin 1 of gate IC-7A thereby providing a logic 0 output on line 30. When the signal on line 66, by reason of closure of switch 64 for example, goes low or to 0, and should a 0 also appear on pin 2 of IC-7A, then pin 3 and line 30 will go high or to logic 1.

AIRHORN OVERRIDE

The apparatus of this invention is capable of generating a speaker output signal having a simulated airhorn sound. Summarizing first and referring to FIG. 2, the two tone siren sound and the airhorn sound are derived from the square wave train C (FIG. 2). For the two tone function, the pulse repetition rate is for the working embodiment disclosed, 60 pulses per minute. For airhorn operation it is 60 pulses per second. Both of these signals selectively appear on the generator output line 44 to the input circuit of VCO 51. As previously explained, the repetition rate of the two tone signal occurs by reason of activation of gate IC-5A which inserts capacitor 12 and provides a capacitance in the present instance of a total value of 39 mfd into the siren signal-generating circuit. This results in producing the train of pulses C at 60 per minute.

For airhorn operation, all of the IC's 5A, 5B and 5D are deactivated leaving only the small capacitor 14 in the siren signal-generating circuit, the value of this capacitor 14 in the illustrated working embodiment being 0.47 mfd. The value of this capacitor 14 determines the airhorn rate of 60 pulses per second.

Airhorn override, in other words, the generation of the airhorn signals can be produced when the functional switch 10 is in one of the following positions: public address position 2, yelp position 5, and two tone position 6. In explaining the override function, reference will be made to the signal produced on the generator output or VCO control signal line 44 since this signal determines which of the emergency sounds are reproduced by the system's speaker.

Referring first to switch 10 operated to select the public address position 2, resistor 88 and diode D7 are connected via line 90 to capacitor 18. This serves to discharge capacitor 18. With switch 10 set to contact 2, logic 0 is on contact 3 and line 50. Pin 2 of NOR gate IC-7A is thus at logic 0. Upon activation of auxiliary circuit 68, line 66 is driven low, causing logic 0 to appear at pin 1 of NOR gate IC-7A and logic 1 on line 30. This signal is applied to all four NOR gates IC-4A, IC-4B, IC-4C and IC-4D changing the states thereof to output 0. Since this removes capacitors 12, 16 and 18 from the siren sound-generating circuit and leaves only capacitor 14 therein, the high repetition rate signal C (FIG. 2) is generated which is coupled through to output line 44. This airhorn signal C is derived from pin 3 of IC-8 which is gated through IC-6D by reason of the fact that pin 12 thereof is activated by logic 1 appearing on line 34 connected to the input side of NOR gate IC-4A. Output line 44 is connected to pin 11 of IC-6D.

Note that line 30 is connected to pin 6 of IC-6C. When line 30 is set to logic 1, IC-6C effectively shorts out resistor 60, which is used to obtain the offset ramp signal on generator output line 44. With IC-6C conductive, the wave form A of FIG. 2 appears on line 20 resulting in producing the desired timing for the airhorn signal.

Thus, considering again that switch 10 is on public address position 2, the microphone 96 (the circuitry not yet described) can be used to reproduce the amplified voice from speaker 98. Should the airhorn override signal be desired, a push button switch 100 connected to the microphone 96 is operated essentially to disconnect the microphone 96 from the circuitry. Upon doing this, no sound will emanate from speaker 98. However, by closing switch 64 of the auxiliary circuit 68, logic 0 will be applied to line 66 causing the airhorn operation just described. This airhorn control signal on line 44 will be transformed and amplified by the remaining circuitry and reproduced by the speakers 98.

AIRHORN OVERRIDE FOR YELP POSITION

By turning switch 10 to yelp position 5, the yelp control signal will be generated and applied to output line 44 as previously described. Once again by closing switch 64, logic 1 will be applied to line 30 changing the state of the yelp NOR gate IC-4C to develop an output 0 at pin 10 which deactivates gate IC-5B. This removes capacitor 16 from the siren signal-generating circuit leaving only the airhorn capacitor 14 therein. Capacitor 14 in circuit with ramp generator 26 produces square wave pulses (FIG. 2), which appear at pin 3 of IC-8, conducted by line 42 to pin 10 of gate IC-6D which has been activated by logic 1 on line 34. The airhorn signal (pulses C) is thus applied to line 44.

AIRHORN OVERRIDE FOR THE TWO TONE POSITION

As previously explained, with function switch 10 turned to two-tone position 6, NOR gates IC-4D and IC-4C have two logic 0 input signals which result in high signals at pins 11 and 10 of IC-4D and IC-4C, respectively. This places capacitors 12 and 16 in the siren signal-generating circuit. Upon activation of circuit 68 by closing, for example, switch 64, once again logic 1 is applied to line 30 which deactivates all of the siren gates IC-4A, IC-4B, IC-4C and IC-4D. This leaves then only capacitor 14 in the circuit which, in cooperation with the ramp generator 26, produces a square wave train of pulses labeled C in FIG. 2. This train of pulses appears at pin 3 of IC-8 and is conducted by line 42 to pin 10 of gate IC-6D which has been activated by the 1 signal on pin 12 appearing on line 34 connected to the input side of gate IC-4A. This places the airhorn signal on output line 44 so long as switch 64 remains closed. When switch 64 is opened, the circuit returns to operating in the two tone mode wherein capacitors 12 and 16 are once again reinserted into the siren signal-generating circuit.

WAIL FUNCTION WITH YELP OVERRIDE

Another function derived from activation of auxiliary circuit 68 is to switch between wail and yelp sounds by cycling switch 64. With the function switch 10 switched to wail position 4, the wail control signal will be presented to output line 44 by reason of the activation of gate IC-5D which inserts the 200 mfd capacitor 18 into the siren signal-generating circuit. The wail signal "B" gives a repetitive steady sequential rise and fall of tones at a relatively low rate. When the yelp sound is desired, switch 64 is closed and immediately opened. During closure, logic 0 as before explained is applied to line 66 which is coupled to clock pin 11 of flip-flop circuit IC-2B. When switch 64 is then opened, the logic 0 to logic 1 transition triggers the clock of the flip-flop IC-2B. This results in cycling the Q and $\overline{Q}$ outputs, Q output becoming 1 and $\overline{Q}$ becoming 0. Since logic 0 already exists on line 30, IC-4C is activated to provide a 1 output which changes the state of IC-5B to conducting. This places capacitor 16 of a lower capacitance, such as 15 mfd, into the siren signal-generating circuit which produces essentially the same wave form as the wail signal except at a higher repetition rate. This yelp signal is taken off line 20 conducted through IC-5C and IC-6A to output line 44.

In order to return the circuit to wail mode, switch 64 is cycled again pulsing the clock pin 11 of flip-flop IC-2B with the logic 0 causing output signals at $\overline{Q}$ and Q to switch the output of $\overline{Q}$ pin 12 to 1 and that of Q pin 13 to 0. Gate IC-4B is activated turning on IC-5D and returning capacitor 18 to the siren signal-generating circuit. The wail signal thereupon appears in the output line 44.

The airhorn signal cannot be produced while the function switch 10 is in the wail position 4. This is prevented by reason of the diode D4 on line 50 which leads to pin 2 of gate IC-7A. This high or 1 signal on pin 2 results in a logic 1 on pin 1 of gate IC-7A thereby holding the output pin 3 in line 30 to logic 0. The only time the airhorn signal may be created is when logic 0 on line 30 is changed to logic 1.

A noise signal derived from, for example, a noisy switch 64, could cause unwanted activation of flip-flop IC-2B which has the capability of being cycled at rates as high as 10 mhz. In order to immunize IC-2B against noise pulses, a small delay circuit in the form of capacitor 102 and resistor 104 connected to D pin 9 and $\overline{Q}$ pin 12 is used. The values of this capacitor 102 and resistor 104 are so selected as to provide a switching rate from wail to yelp and back of IC-2B of no less than about ½ second. This in effect, inhibits any change of state of the flip-flop output after the initial clock pulse for a certain length of time. More specifically, when $\overline{Q}$ pin 12 goes to logic 1, the capacitor 102 charges through resistor 104. This provides a logic 1 level on D pin 9 only after the length of time necessary to charge capacitor 102 above the 4 volt threshold. During this time period, clock pulses generated by noisy contacts will still be clocking the same data logic 0, so the outputs $\overline{Q}$ and Q will remain the same. The same effect occurs inversely on the next switch 64 closure after the capacitor 102 is charged to logic 1 level at D pin 9. In other words, clock pulses, or noise pulses, have no further affect on IC-2B for about ½ second after the initial pulse.

VOLTAGE CONTROLLED OSCILLATOR

The variable frequency, voltage controlled oscillator, indicated by the dashed line box 51, produces in response to a varying input voltage a variable frequency square wave output signal ("G" of FIG. 2) which is amplified and reproduced by the speaker 98 to provide the siren sounds. A typical oscillator is disclosed in Smith U.S. Pat. No. Re. 28,745. The voltage controlled oscillator of the aforesaid patent may be used in place of the oscillator 51 of this circuit if desired. The circuit of this invention, however, utilizes integrated circuits instead of transistors and requires less critical circuit parameters than the circuit of the aforesaid patent.

Referring to FIG. 3 of this application, the generator line 44 constitutes the input circuit to the oscillator 51. The oscillator 51 includes two high gain inverters IC-3E and IC-3F. Two resistors 110 and 112 are connected, rspectively, to the input sides of the these integrated circuits, with a capacitor 114 being connected between the input and output sides of the two IC's 3E and 3F, respectively, and another capacitor 116 being connected as shown between the input and output sides of the IC's 3F and 3E, respectively. Two diodes 118 and 120 are, respectively, connected in shunt with the respective capacitors 116 and 114 in the specific polarity shown.

An output line 122 connects between pin 10 of IC-3E and pin 3 of IC-2A which is a D-flip-flop configured as a divide-by-two counter. A siren signal output line indicated by the numeral 124 connects to pin 1 of this counter.

Depending upon the position of switch 10, the signals B, C and D of FIG. 2 appear on line 44 and are applied to the input circuit of the oscillator 51. The oscillator 51 may be loosely described as a free-running multivibrator wherein the frequency or repetition rate of the generated square wave is determined by the time constant of resistor 110 and capacitor 114 on the one hand and resistor 112 and capacitor 116 on the other. The diodes 118 and 120 are connected in such polarity that the frequency of the signal generated by the oscillator 51 varies conversely with the variation in voltage on line 44. Thus, as the voltage on line 44 increases, the frequency generated by the oscillator 51 decreases.

Oscillator 51 in response to one of the signals B, C or D of FIG. 2 supplies a generally square or rectangular wave of varying frequency to pin 3 of the counter IC-2A. This signal on pin 3 varies in amplitude from below to above the level of the threshold voltage on pin 3 which serves to trigger the counter, this threshold level being 4 volts. This counter IC-2A is triggered once for each complete cycle of a signal applied to pin 3 to generate a symmetrical square wave signal at the output pin 1. The counter is triggered to a change of state in generating this square wave only upon that portion of the wave applied to pin 3 that is positive-going, there being no change of state for the negative-going portion. Thus, the counter IC-2A divides the frequency of the signal applied to pin 3 by two and in turn generates a symmetrical square wave at the output pin 1. It is this symmetrical square wave, varying in frequency, which is amplified and reproduced as a siren signal from speaker 98.

A circuit is provided for cutting off the operation of the oscillator 51 when the frequency of the generated signal reaches a relatively low level, such as 285 hz. This circuit includes the capacitor 126 leading from pin 12 of IC-3F to the input pin 5 of operational amplifier IC-9B. Pin 6 of this amplifier is biased by means of a voltage divider composed of two resistors 128 and 129 connected in series. Output pin 7 of amplifier IC-9B is connected to pin 2 of a second operational amplifier IC-9A by means of series connected resistor 130 and diode 132. A capacitor 134 connects between the anode of diode 132 and ground. Pin 3 of amplifier IC-9A has a bias voltage applied thereto via the voltage divider composed of resistors 136 and 138 which determines the level of voltage on pin 2 of amplifier IC-9A required to activate the latter.

The signal appearing on pin 12 of inverter IC-3F in the oscillator 51 is a square wave substantially conforming to the shape of wave E of FIG. 2. This signal E coupled to pin 5 of operational amplifier IC-9B is changed in shape to appear as wave F of FIG. 2 at pin 7. The negative-going spikes of wave F are used to discharge any charge build-up on capacitor 134 as will now be explained.

The supply line 28 is connected to capacitor 134 through resistor 140. Any charge build-up on capacitor 134 is discharged by the negative-going spikes of wave F. So long as the frequency of the signal appearing on output line 124 of oscillator 51 is above 285 hz, the level of charge build-up on capacitor 134 will remain below the voltage threshold level of high gain operational amplifier IC-9A. However, should the frequency drop below 285 hz, a sufficient charge build-up to above the voltage threshold level will occur on capacitor 134, before one of the negative spikes of wave F occurs and discharges the same. This capacitor 134 voltage is applied to pin 2 of operational amplifier IC-9A having an output which is normally high when the threshold voltage is low and changes state when the threshold voltage goes high, producing a diminished output on pin 1 which may be considered a logic 0. This logic 0 applied to pin 9 of inverter IC-3D results in logic 1 on pin 8 thereof and pin 9 of counter IC-2A. This logic 1 deactivates the counter thereby cutting off the output signal at pin 1 (line 124). Thus, when the frequency of the oscillator 51 drops below a predetermined value, the circuitry in the dashed line box now indicated by the numeral 142, which may be characterized as a frequency detector, serves to disable the counter IC-2A and prevent any signal from being applied to output line 124.

COUNTER IC-2A FUNCTION DURING SELECTION OF PUBLIC ADDRESS OPERATION

For public address operation, the supply voltage is applied to contact 2 of switch 3. By reason of the presence of diode D6, and resistors 144, 146 and 148, a positive voltage will appear on line 150. The value of this voltage on line 150 is determined by the value of the resistor 146, among others, and the voltage on line 66. Circuit values are so selected that with a logic 1 signal on line 66, the voltage appearing on line 50 will be above the threshold level of four, or in other words, about five volts. This five volts, which may be considered as a logic 1, is connected to pin 9 of NOR gate IC-7C bringing output pin 10 low or to logic 0. Inverter IC-3D, pin 9, goes to logic 0 and pin 8 switches to logic 1. This logic 1 on pin 9 of counter IC-2A disables the latter resulting is no output signal at pin 1. This counter IC-2A must be disabled during public address operation.

Thus, during the time switch 3 is on contact 2, no siren signals appeal on output line 124.

AIRHORN OVERRIDE DURING SELECTION OF PUBLIC ADDRESS OPERATION

Again, with switch 10 on position 2, the microphone 96 may be switched into the circuitry by closing the spring biased switch 100 thereby enabling the system to be used for public address purposes. Upon closure of switch 100, line 152 is grounded, which in turn brings pin 9 of inverter IC-3D low or to logic 0. Inverter pin 8 and counter pin 9 thereby have a logic 1 appearing thereon which effectively disables counter IC-2A.

If an airhorn sound is desired, the switch 100 is released such that the contacts thereof open. Auxillary circuit 68 is activated (for example by closing switch 64) which results in a logic 0 signal being applied to line 66 and generation of the airhorn signal corresponding to wave C of FIG. 2 on line 44. The logic 0 on line 66 results in lowering the voltage on resistor 146 and line 150 to a level below threshold, or in other words, to logic 0. This logic 0 signal is applied to pin 9 of NOR gate IC-7C which normally has a logic 0 on pin 8 thereof. Logic 1 now appears on pin 10 which upon being coupled to pin 9 of inverter IC-3D produces a logic 0 on pin 8 which is applied to pin 9 of counter IC-2A. This enables counter IC-2A permitting it to function to generate a siren signal corresponding to the airhorn sound on output line 124. This airhorn signal is then amplified and reproduced by speaker 98.

PROTECTION AGAINST OVER VOLTAGE FROM THE POWER SUPPLY

The supply voltage is normally derived from a twelve volt vehicle battery. If a malfunction in the supply voltage system should occur which might cause the supply to increase above a given level, e.g. 16 volts, the zener diode 154 (selected to break down at 12 volts) breaks down causing a current flow through resistor 156. With the supply voltage being at sixteen plus, for example, the breakdown voltage of the diode 154 being 12 volts, a voltage will now appear at the anode of diode 154 in excess of the threshold level of four volts. This logic 1 signal is applied to pin 8 of NOR gate IC-7C resulting in a logic 0 on pin 10. This logic 0 signal applied to pin 9 of inverter IC-3D produces a logic 1 at pin 8 which is applied to pin 9 of counter IC-2A disabling the latter. Thus, for an overvoltage condition, the counter IC-2A is disabled preventing siren signals from being applied to output line 124, which signals in the case of an overvoltage condition, would be of excessive amplitude such as could damage portions of the remaining circuitry, especially the speaker 98.

FUNCTION SELECTING CIRCUITRY

The switch 10, previously described, is one of three wafers of a rotary switch, the other two switch wafers being indicated by the numerals 160 and 162, the rotors of all three wafers being mounted on a common shaft such that the respective stator contacts are in registry.

A transistor amplifier 164 has the base thereof connected to output line 124 through a buffer resistor 166. The collector 168 is coupled to contacts 3 through 6 of switch 160. The rotors 170 and 172 of the two switches 160 and 162, respectively, are connected to the opposite ends of the primary of a transformer 174 at the input end of the audio amplifier generally indicated by the numeral 176. Contact 2 of switch 160 is connected to the rotor 178 of a potentiometer 180 connected between supply line 28 and a microphone terminal 182. Terminal 182 connects to normally open switch 184 which is one section of the spring biased, normally open, double pole single throw switch 100, the other side of switch 184 leading to the microphone 96 having its other terminal grounded as shown. Contact 2 of switch 160 is also connected to contact 3 by means of a coupling resistor 186 and a diode 188.

With the function switch 10, 160, 162 turned to one of the positions 3 through 6, the corresponding siren signal will appear on output line 124 which is amplified by transistor amplifier 164 and coupled to the switch rotors 170 and 172 in turn connected to the primary of transformer 174 via lines 171 and 173, respectively. The corresponding siren signal is thus coupled to the transformer 174, amplified by the amplifier 176 and reproduced by the speaker 98.

By closing the switch 100, the siren signal normally appearing on output line 124 is disabled and the microphone 96 enabled such that the system may be used for public address purposes. Signal from the microphone appearing across the potentiometer 180, which serves as a volume control for the microphone, is picked off by the rotor 178 and coupled to the contacts 3 through 6 of switch 160 which are in turn coupled to the primary of the transformer 174. Signals picked up by the microphone 96 are thereupon amplified and reproduced by speaker 98, the siren signal having been cut off. Thus, the positions 3 through 6 of the function switch 10, 160, 162 are subject to microphone override.

With the function switch in position 2, the microphone is connected directly to the primary of the transformer 174. Airhorn override is achieved by releasing the switch 100 thereby opening the contacts thereof and then activating the auxiliary circuit 68, such as by closing switch 64, which results in the airhorn signal being applied to line 124, amplified by the transistor amplifier 164 and coupled to contact 2 of switch section 160 by means of diode 188. The airhorn signal is thus applied to the primary of transformer 174, amplified and then reproduced by the speaker 98.

For position 1 of the function switch, a circuit to the primary of transformer 174 is established to an auxiliary radio output circuit having terminals 190. A potentiometer 192 is connected across terminals 190 and serves as a radio volume control.

THE POWER SUPPLY CIRCUIT

A vehicle battery 194 which normally delivers twelve volts has its negative terminal grounded and the positive terminal connected to a main control switch 196 via a twenty ampere fuse 198. A diode 200 is connected between the switch 196 and ground and is so selected that it will burn out upon connecting battery 194 in reverse polarity. This provides an indication to a repairman that the initial battery connections were improperly applied.

Also connected to switch 196 is a voltage regulator in the form of IC-1, the regulated line at eight volts serving as the main supply bus 28. Filter capacitors are connected between the supply lines and ground.

POWER AMPLIFIER

The power amplifier, generally indicated by the numeral 176, includes the transformer 174 having the secondary connected to the bases of the two NPN, driver transistors 202 and 204, respectively. Bias for the bases is provided by the voltage divider network composed of the resistors 206, 208, 210 and 212, the resistor 212 being in the form of a thermister. The bias voltage applied to these bases is of a value, for example, of about 0.6 volts, so as to operate the driver amplifier portion composed of the two transistors 202 and 204 in class B mode.

Two resistors 214 and 216 are connected between the collectors and bases of the two transistors 202 and 204, respectively, to provide negative feedback.

The collectors of the two transistors 202 and 204 are connected to taps 218 and 220 on the primary winding 222 of the transformer 224, the taps 218 and 220 being equally spaced on the winding 222 from the center tap 226. The primary 222 is in the form of an autoformer winding, the center tap 226 having a bias voltage applied thereto by reason of the resistor 228 connected at one end to ground and at the other end to a diode 230 connected to the B supply voltage. Two equal loading resistors 232 and 234 are connected across the respective halves of the primary 222 as shown.

PNP output transistors 236, 238, 240 and 242 are in modified Darlington pair configurations with the bases of the two transistors 236 and 240 coupled to the ends of a primary winding 222 by means of two resistors 244 and 246, respectively. A frequency-limiting capacitor 248 is connected between the base of transistor 240 and ground.

A secondary or tickler winding 250 on the transformer 224 has the center tap grounded and the ends connected to the collectors of the two transistors 236 and 240, respectively.

The collectors of the transistors 238 and 242 are grounded and the emitters are connected to the opposite ends of the primary 252 of output transformer 254. Speaker 98 is connected to the secondary 256. B supply voltage is connected to the center tap 258 of the primary 252.

A frequency-limiting capacitor 260 is connected between the collectors of the two transistors 202 and 204.

In operation, the square wave siren signal of varying frequency, indicated as wave G in FIG. 2, voice or radio output signals are coupled to the primary of transformer 174 depending upon the position of the function switch 10, 160, 162. Considering first the square wave siren signal, it is amplified by the driver transistors 202 and 204 and fed to the primary winding 222 of transformer 224. The signals appearing at the ends of this winding 224 are coupled to the bases of the two transistors 236 and 240, driving them between cut-off and saturation with each cycle of the square wave. The secondary or tickler winding 250 on the transformer 224 is wound to be in phase with the primary winding 222, meaning that the signals applied to the base and collector, respectively, of transistor 236 are in phase as are the signals to the collector and base of the transistor 240. In stand-by mode, that is in the absence of a signal applied to transformer 174, these collectors of transistors 236 and 240 are grounded and the transistors are biased to just below cut-off by reason of the potential drop over the diode 230 connected to the center tap 226 of winding 222. However, with the application of a siren signal to the transformer 174, the amplitude of the signal applied to the bases of the transistors 236 and 240, in the embodiment shown, will swing between the potential limits of about minus three (−3) volts to about twenty-five (25) volts while the potentials on the collectors thereof will swing from a value of about two (2) plus to about two (2) volts negative or below ground, the positive and negative voltages alternating between the two collectors. The transistors are driven into saturation to obtain maximum gain at minimum power loss.

The emitters of the two transistors 236 and 240 are respectively connected to the bases of the two transistors 238 and 242. By reason of the negative, dynamic bias on the collectors of the transistors 236 and 240, the emitters thereof are likewise lowered in voltage as are the bases of the two transistors 238 and 242. These bases are thus driven negatively by a value beyond that required to drive the two transistors 238 and 242 into saturation whereupon maximum signal current flows, with minimum emitter to collector impedance, between the emitters and ground.

For the embodiments shown, it is important that the bases of the two transistors 238 and 242 be driven negatively, sufficient to drive the transistors into saturation. The amount of this negative drive is sufficient to overcome the normal emitter-base voltage drop, which for the embodiment shown is about one (1) volt for each transistor operating at a high current level. By overcoming or cancelling out this potential drop by reason of the negative biasing signal on the bases, the transistors are quickly driven into saturation with the emitter-collector impedance or potential drop thereupon lowering to the minimum possible. Since current flow from maximum power output from the transformer 254 produces a current of about fifteen (15) amperes through the primary 252, the transistors 238 and 242 experience minimal internal heating and power loss.

It is to be understood, of course, that the Darlington pairs 236, 238 and 240, 242 alternate in conductivity. To better understand the significance of the tickler winding 250, circuit operation may be considered for the case in which the collectors of transistors 236 and 240 are directly grounded. In this condition, it is not possible to swing the bases of the two transistors 238 and 242 sufficiently negative to drive the transistors into full saturation without excessive power loss. With the tickler coil in the circuit, a negative two (2) volts is applied to the collectors of transistors 236 and 240 which compensates for the base-emitter junction voltage (of about one (1) volt) for transistors 238 and 240 and also the collector-emitter voltage (about 0.4 volts) for transistors 236 and 240. For example, with negative two (2) volts on the collectors of transistors 236 and 240, the voltage appearing on the emitters thereof is two minus four tenths which is about one and six tenths (1.6) volts negative. This negative 1.6 volts is applied to the bases of transistors 238 and 242, which is greater than the base voltage of one (1) volt required to drive these transistors 238 and 242 fully conductive well into saturation.

Stated otherwise, the total emitter to collector saturation voltage drop for each Darlington pair is about one and four tenths (1.4) volts, which is effectively overcome by the negative two (2) volts applied to the collectors of transistors 236 and 240. The base-emitter junction voltage drop for transistors 236 and 240 is compensated for by the base signal from the autoformer winding dropping to about three (3) volts negative. The transistors of the Darlington pairs can thus be fully driven in saturation.

Explaining this operation further, grounding directly the collectors of the two transistors 236 and 240 results in an emitter-collector voltage drop for transistors 238 and 242 when they are turned "on". The reason for this is that the emitter-collector drop for transistors 236 and 240 is about 0.4 volt which appears in positive polarity on the emitters thereof and the bases of transistors 238 and 242. The latter are not, therefore, turned fully "on" which results in the emitter-collector drop, or in other words an impedance between the emitter and collector. At high currents, this impedance results in relatively high voltage drops and power loss with consequent heating. By application of the dynamic negative bias to the collectors of the two transistors 236 and 240, these transistors 238 and 242 when turned "on" are immediately driven to saturation fully, thereby reducing the emitter-to-collector impedance to near zero which results in minimal potential drop or power loss with full load current. In this consideration, it is desired to swing the emitters of the two transistors 238 and 242 as close to ground potential as possible.

By reason of the circuit configuration wherein the Darlington pair emitter (transistor 238, 242) to collector (transistor 236, 240) junction saturation voltage, in this instance one and four tenths (1.4) volts, is effectively cancelled out by the application of the dynamic bias from the tickler winding 250, it is possible to operate the transistors in the saturated mode with minimum power losses. In the specific embodiment of this invention as disclosed, amplifier efficiency in the vicinity of 90% to 94% may be achieved. This is a significant increase over efficiencies of comparable prior art devices.

Also, prior art devices that do function to drive the output transistors into saturation require significantly higher driving currents than required in this invention. Thus, in this invention, less current is required to drive the output transistors to saturation which also contributes to a further reduction in power losses, internally developed heating, and to increased overall circuit efficiency.

The specific embodiment of this invention utilizes silicon transistors in contrast to germanium. Such silicon transistors can withstand much higher operating temperatures than can the germanium. The use of such silicon transistors in the particular circuit configuration disclosed leads to another advantage of protection against transistor burn out in the event of a short across the secondary 256 of transformer 254. Under such shorted conditions, it has been found that the current in the primary 252 which flows through the transistors 238 and 242 reaches a value of about forty-five (45) amperes. Since there is adequate drive on the bases of these transistors to maintain them in saturated condition, the emitter to collector impedance is sufficiently low that the internal heat build-up due to this high overload current does not produce temperatures, over a relatively long period of time, which could burn them out. Since these transistors can safely draw this amount of current for a relatively long period, before damaging temperatures are reached, the fuse 198, which requires a finite time to open circuit, will soon burn out. This, inherent protection of the transistors 238 and 242 is provided. The fuse 198 and the circuit disclosed is rated at twenty (20) amperes.

The silicon transistors in the modified Darlington pair configuration having the circuit and operating parameters herein given inherently provides high gain with low level base drive. This low level drives minimizes base junction heating and the possibility of transistor burn-out. While the drive on the bases of transistors 236, 240 remains the same, that on the bases of transistors 238, 242 automatically adjusts with changes in load current (emitter to collector) as in the case of conventional Darlington pair circuits. For example, a drop in load current results in a drop in the emitter-base current which is the supply current for transistors 236, 240. This reduced emitter-base current becomes the base drive for the transistors 238, 242. Since the base drive is reduced, base junction heating which would result from the higher value of base drive for the higher load current is avoided. Restating, then, the base current adjusts automatically in response to the load current.

By reason of the dynamic bias provided by winding 250 on the collectors of transistors 236, 240, the bases of transistors 238, 242 are maintained sufficiently negative as explained previously assuring saturation.

The same logic applies should the load current increase, as in the case of a short circuit in the speaker 98, in which event the base current on the transistors 238, 242 automatically increases to maintain saturation at the higher currents of, for example, forty-five amperes as previously stated. Thus, in this modified Darlington pair circuit the dynamic bias along with adjustable base drive for different load current conditions minimizes or avoids transistor burn-out while the amplifier efficiently develops high gain.

In the audio mode, the transistors 236, 238, 240 and 242 are operated in unsaturated state. The primary winding 252 of output transformer 254 is coupled at the opposite ends thereof to the emitters of transistors 238 and 242. The amplifier circuit 236, 238, 240, 242 in response to the audio signal applied to the bases of transistors 236 and 240 operates with the transistors in unsaturated state, in part by reason of inductive feedback originating in the secondary winding 256 reflected into the primary 252 through transistors 238, 236 and 242, 240 and into the secondary 250 and primary 222 of transformer 224. The driver transistors 202 and 204 are connected to primary 222 and have negative feedback resistors 214 and 216, connected between the collectors and bases, respectively. The modified Darlington pairs 236, 238 and 240, 242 are thus driven short of saturation in amplifying the audio signals.

The circuitry and components including the transformers 224, 254 along with the modified Darlington pairs 236, 238 and 240, 242 which provides for such saturated and unsaturated states constitute a dynamic circuit means which functions in both the audio and siren modes as explained.

The drawings and specification disclose a working embodiment of this invention, and the values and parameters, listed in the following, of the various components and parts therefor are exemplary only, since others may be used without departing from the spirit and scope of this invention.

| RESISTORS ("K" = 1000 ohms) | |
|---|---|
| R1, R2, R3, R4, R6, R9, R10, 58, 60, 67, R41, R14, R19 | 4.7K |
| 108 | 47K |
| 104, R40 | 68K |
| 62, R29, R31 | 22K |
| R17, R37 | 100K |
| R18 | 12K |
| 70, 76, 148, 144 | 2.2K |
| 72, 74, 84, R38 | 1K |
| R26 | 27K |
| 110, 112 | 75K |
| R30, 232, 234 | 3.3K |
| 129, R36, 166, 214, 216 | 8.2K |
| R46, 130 | 220 ohms |
| R34 - Select for desired frequency | 10K, 12K, 15K or 18K |
| R35 | 3.9K |

-continued

| | |
|---|---|
| R39 | |
| R44 | 270 ohms |
| 180 | 350 ohms |
| 186, 88 | 470 ohms |
| R48, 228 | 680 ohms |
| 192 | 500 ohms |
| 208 | 390 ohms |
| 210 | 27 ohms |
| 206 | 33 ohms |
| 212 (thermister part No. 2D2224, Midwest Components, Inc.) | 210 ohms |
| R68, 227 | 1.0 ohms |
| 244, 246 | 100 ohms |

CAPACITORS
(in micro farads unless otherwise specified)

| | |
|---|---|
| 46, C7, C8, C13, C14, C15, C16 | 0.05 |
| 102 | 6.8 |
| 12 | 39.0 |
| 14 | 0.47 |
| 16 | 15.0 |
| 18 | 200.0 |
| 114, 116 | 0.0047 |
| 126, 260 | 0.01 |
| 134 | 6.8 |
| C17 | 200 at 15 volts |
| C18 | 0.22 |
| C19 | 47.0 |
| 248 | 0.001 |

DIODES (solid state)
All diodes are 1N4003, except as noted below.

| | |
|---|---|
| 154 | 1N5242B |

INTEGRATED CIRCUITS

IC-2 through IC-7, 57, 59:
Pin 14 = + voltage
Pin 7 = ground
IC-9:
Pin 8 = + voltage
Pin 4 = ground

| | National Semiconductor Corp. Part Nos. | Motorola Corp. Part Nos. |
|---|---|---|
| IC-1 | LM7808 | MC 7808 +8V. Regulator |
| IC-2 | CD4013 | MC 14013 Dual D-Flip-Flop |
| IC-3 | CD4069 | MC 14069 Hex Inverter |
| IC-4 & 7 | CD4001 | MC 14001 Quad 2-Input NOR Gate |
| IC-5 & 6 | CD4016 | MC 14016 Quad Anolog Switch |
| IC-8 | LM555C | MC 1455 (555 Timer) |
| IC-9 | LM1458 | MC 1458 (Dual Op-Amp) |

TRANSISTORS

| | |
|---|---|
| 164 | MPSA 20 (Motorola) |
| 202, 204 | MD40D-13 (Motorola) |
| 236, 240 | 2N6107 - standard part no. |
| 238, 242 | 2N5883 - standard part no. |

While there have been described above the principles of this invention in connection with specific apparatus, it is to be clearly understood that this description is made only by way of example and not as a limitation to the scope of the invention.

What is claimed is:

1. In electronic siren apparatus, (a) means for generating one of a square wave siren and intelligible audio signal, (b) a power output amplifier circuit comprising:

(1) a first transistor amplifier means for amplifying a selected one of said signals, said transistor amplifier means includes a pair of transistor devices connected in push-pull circuit configuration, each of said pair of transistor devices being modified Darlington pair circuits, respectively, each Darlington pair circuit including two transistors in which one of the emitter and collector of the first transistor is connected to the base of the second transistor, (2) first circuit means coupling said signal generating means and the siren signal thereof to the bases of the first transistors of said Darlington pair circuits, (3) said first circuit means including biasing circuit means for applying a dynamic biasing voltage derived from said siren signal to one of said emitter and collector of said first transistors in phase with the voltage of said siren signal coupled to the bases thereof, said dynamic biasing voltage being of a magnitude and polarity that overcomes the emitter to collector junction voltage drop of said first transistors and the base to emitter junction voltage drop of the second transistors, respectively, for driving said transistors alternatively between cut-off and saturation, and (4) means coupled to the emitters and collectors of said second transistors for audibly reproducing the amplified selected one of said signals.

2. The apparatus of claim 1 wherein said first circuit and biasing circuit means includes a transformer having primary and secondary windings, the primary winding being coupled at its opposite ends to the bases of said first transistors, respectively, and said secondary winding being coupled at its opposite ends to one of the emitters and collectors thereof, respectively.

3. The apparatus of claim 2 wherein said reproducing means is connected to the emitter and collector elements of the second transistors of each Darlington pair circuit.

4. The apparatus of claim 3 wherein the collector elements of said first paid of transistors are connected to said secondary winding and the collector elements of said second pair of transistors are connected together and to a center tap on said secondary winding, said reproducing means including an output transformer having the opposite ends of a winding thereof connected, respectively, to the emitter elements of said second pair of transistors.

5. The apparatus of claim 1 wherein the magnitude of said biasing voltage at least equals the sum of said emitter to collector voltage drop plus the value of voltage on the second transistor base required to drive each second transistor into saturation.

6. The apparatus of claim 5 wherein said transistors are silicon, said transistor amplifier means including a power supply having a fuse device in series therewith, said fuse device having the characteristic of disconnecting the power supply from the transistors when the current drawn by the latter in saturated condition due to an overload exceeds the normal operating current thereof.

7. The apparatus of claim 6, wherein the overload current of said transistors exceeds the value of the disconnecting current of said fuse device and is less than the burn-out current for said transistors for the time required for said fuse device to disconnect.

8. The apparatus of claim 4 wherein said primary winding is center-tapped and biased with a voltage which renders said transistors non-conductive in the absence of a siren or audio signal, said secondary winding having a center tap which is grounded, said collector elements of said second pair of transistors being grounded, and said transistor amplifier means including a power supply having its positive terminal connected to a center tap on said output transformer winding.

9. The apparatus of claim 8 wherein said primary winding has a capacitor to ground from one end thereof to prevent ringing when said amplifier means has a siren signal applied thereto.

10. The apparatus of claim 5 wherein said reproducing means includes an output transformer having primary and secondary windings, the last-mentioned primary winding being coupled at the opposite ends thereof to the emitter and collector elements of the second transistors of each Darlington pair circuit, said amplifier means in response to an audio signal applied thereto operating with said transistors unsaturated, in part by reason of inductive feedback originating in the secondary winding of said output transformer reflected into the primary winding thereof through said transistors and into the secondary and primary windings of the first-mentioned transformer.

11. The apparatus of claim 10 in which said amplifier means includes a pair of driver transistors in push-pull connected to the primary winding of said first transformer, negative feedback means coupled between selected elements of said driver transistors thereby to drive the Darlington pair circuits short of saturation when said audio signal is applied as aforesaid.

12. The apparatus of claim 9 wherein said first transformer primary winding has a load resistance means thereacross and to ground.

13. The apparatus of claim 2 wherein said primary winding is in the form of an autoformer winding.

14. The apparatus of claim 11 wherein said primary winding of said first transformer is an autoformer winding with said driver transistors being coupled thereto inwardly from the opposite ends thereof, respectively.

15. An audio power amplifier comprising a pair of driver transistors connected in a push-pull circuit configuration, a first input coupling transformer having a winding connected at its opposite ends, respectively, to the bases of said driver transistors, the center of said winding being connected to ground by means of a resistor divider network that biases said transistors to operate in Class B mode, the emitters of said transistors being connected in common and coupled to ground;

a second transformer having primary and secondary windings, the primary winding of said second transformer being in the form of an autoformer winding, the collectors of said driver transistors being connected, respectively, to points on said autoformer winding inward from the opposite end equidistant from the center thereof, two feedback resistances being connected, respectively, between the bases and collectors of said transistors, two load resistances being connected between the opposite ends, respectively, of the autoformer winding and the center thereof, a frequency-limiting capacitor connected between said collectors;

two Darlington transistor pairs connected in a push-pull circuit configuration, the bases of the first transistors of each pair being coupled to the ends, respectively, of said autoformer winding, the collectors of said first transistors being connected to the opposite ends, respectively, of said secondary winding, the center of said secondary winding being grounded, the center of said autoformer winding being connected to a positive potential by means of a diode-biasing network for biasing said Darlington pairs to just below cut-off in the absence of a siren or audio signal, the emitters of said first transistors being connected, respectively, to the bases of the second transistors, the collectors of said second transistors being grounded, and an output transformer having primary and secondary windings, the opposite ends of said output transformer primary winding being connected to the emitters, respectively, of said second transistors, a source of supply voltage connected to the center of the last-mentioned primary winding, and a speaker connected to the last-mentioned secondary winding.

16. The amplifier of claim 15 wherein said first and second transistors are silicon.

17. In electronic siren apparatus, (a) means for generating one of a square wave siren and intelligible audio signal, (b) a power output amplifier circuit comprising:

(1) a first transistor amplifier means for amplifying a selected one of said signals and having base, emitter and collector means, (2) first circuit means coupling said signal generating means to said base means and one of said emitter and collector means for driving said transistor amplifier means with said siren and audio signals, (3) said first circuit means including dynamic circuit means connected between said base and one of said collector and emitter means, responsive to said siren signal, for applying a dynamic biasing voltage to said one of said collector and emitter means which, along with such siren signal, drives said transistor amplifier means between cut-off and into saturation said dynamic circuit means being further responsive to said audio signal for applying a feedback voltage derived from said one of said collector and emitter means to said base means which, along with such audio signal, drives said transistor amplifier means short of saturation, whereby said transistor amplifier means is saturated in amplifying said siren signal but unsaturated in amplifying said audio signal, and (4) means coupled to said other of said emitter and collector means for audibly reproducing the amplified selected one of said signals.

18. The apparatus of claim 17 wherein said first circuit and dynamic circuit means includes a transformer having primary and secondary windings, the primary winding being coupled to said base means and said secondary winding being coupled to said one of said emitter and collector means.

19. The apparatus of claim 18 wherein said transistor amplifier means includes a pair of transistor devices connected in a push-pull circuit configuration, said base means including the base elements of said transistor devices and said one of said emitter and collector means including the emitter and base elements thereof, respectively.

20. The apparatus of claim 19 wherein opposite end portions of said primary winding are coupled to said base elements, respectively, the opposite end portions of said secondary winding being operatively coupled to said one of said emitter and collector elements, respectively.

21. A signal generating circuit for an electronic siren comprising first means for generating selectively a plurality of control voltage signals having predetermined wave shapes and frequencies; second means for generating siren signals at a variable frequency proportional to the amplitude of said control voltage signals; said first means including function switch means for manually selecting predetermined ones of said control signals, said first means also including auxiliary switch means for manually switching said first means successively between two of said control signals when said function switch means is operated to select one of said two control signals and for manually switching said first means to select a third control signal when said function switch means is operated to select a fourth control signal.

22. The circuit of claim 21 wherein said first means includes a first time constant and wave-shaping circuit for determining the shape and frequencies of said third and fourth control signals, and gating switch means responsive to operation of said auxiliary switch means for switching said time constant and wave-shaping circuit between said third and fourth control signals.

23. The circuit of claim 22 wherein said time constant and wave-shaping circuit includes first and second capacitors connected in shunt with a resistance, said gating switch means including a first relay gate in series with said first capacitor and a second relay gate in shunt with at least a portion of said resistance, said first and second capacitors in conjunction with the resistances thereacross determining the characteristics of said third and fourth control signals, respectively.

24. The circuit of claim 23 wherein said third and fourth signals have square wave shapes.

25. The circuit of claim 21 wherein said first means includes a plurality of time constant and wave-shaping circuits for determining the shapes and frequencies of said control signals, gating switch means responsive to operation of said auxiliary switch means for switching said time constant and wave-shaping circuits between said two, said third and fourth control signals; said time constant and wave-shaping circuits including a plurality of capacitors operatively coupled in shunt, a plurality of relay gates series connected with said capacitors, respectively, and in circuit with a resistance, said capacitors alone and in combination determining the characteristics of the last-mentioned control signals; said gating means further including first logic circuitry connected between said function switch means and said relay gates responsive to operation of said function switch means selectively to change the conductive states of said relay gates for correspondingly switching said capacitors, respectively, into and out of circuit with said resistance.

26. The circuit of claim 25 wherein said auxiliary switch means includes a manually operable switch in circuit with second logic circuitry for altering the states of conductivity of selected ones of said relay gates from the states determined by said first logic circuitry.

27. The circuit of claim 26 wherein said two signals correspond to wail and yelp sounds, respectively, and said third and fourth signals corresponding to airhorn and two tone sounds, respectively.

28. The circuit of claim 26 including power amplifier means connected to said second means for audibly reproducing said siren signals, circuit means including said function switch for connecting a microphone to said amplifier means, said circuit means including microphone switch means manually operable for connecting said microphone to said amplifier means while simultaneously disconnecting said second means therefrom, whereby said amplifier may be used as a public address system which overrides the siren operational mode.

29. The circuit of claim 28 wherein said function switch includes a position for coupling said microphone to said amplifier means, and signal override circuit means connecting said microphone switch means and said auxiliary switch means for connecting said third signal to and disconnecting said microphone from said amplifier means upon actuation of said microphone switch means followed by actuation of said auxiliary switch means.

* * * * *

UNITED STATES PATENT AND TRADEMARK OFFICE

CERTIFICATE OF CORRECTION

PATENT NO. : 4,189,718

DATED : February 19, 1980

INVENTOR(S) : William H. Carson et al

It is certified that error appears in the above-identified patent and that said Letters Patent are hereby corrected as shown below:

Col. 5, line 18, "tones" should be --tone--.
Col. 7, line 68, insert --pin-- before "4".
Col. 8, line 51, "functional" should be --function--.

Claim 4, col. 20, line 38, "paid" should be --pair--.
Claim 15, col. 21, line 52, "end" should be --ends--.

Sheet 4 of the drawings should be deleted to insert the attached sheet therefor.

Signed and Sealed this

*Ninth* Day of *December 1980*

[SEAL]

*Attest:*

SIDNEY A. DIAMOND

*Attesting Officer*

*Commissioner of Patents and Trademarks*

Disclaimer 4,189,718.—*William H. Carson; Gerald D. Smith* and *Frank R. Owens,* Indianapolis, Ind. ELECTRONIC SIREN. Patent dated Feb. 19, 1980. Disclaimer filed July 18, 1983, by the assignee, *Carson Manufacturing Co., Inc.*

Hereby enters this disclaimer to claims 21 to 29 of said patent.

[*Official Gazette October 11, 1983.*]